US005196893A

United States Patent [19]

Nishise et al.

[11] Patent Number: 5,196,893

[45] Date of Patent: Mar. 23, 1993

[54] IMAGE FORMING METHOD AND APPARATUS HAVING INTERMEDIATE TRANSFER MEMBER WHICH IS MOVABLE TOWARD AND AWAY FROM A PHOTOCONDUCTOR

[75] Inventors: Hideya Nishise; Masaru Imaizumi; Toshiyuki Sakai; Katsuhiko Takeda; Hideo Kitakubo, all of Osaka, Japan

[73] Assignee: Minolta Camera Kabushiki Kaisha, Osaka, Japan

[21] Appl. No.: 287,845

[22] Filed: Dec. 21, 1988

[30] Foreign Application Priority Data

Dec. 22, 1987 [JP] Japan ..... 62-326487
Dec. 22, 1987 [JP] Japan ..... 62-326488

[51] Int. Cl.[5] ..... G03G 15/16
[52] U.S. Cl. ..... 355/271; 355/296
[58] Field of Search ..... 355/296, 271, 274, 276, 355/272, 273, 299; 101/494, 489, DIG. 37

[56] References Cited

U.S. PATENT DOCUMENTS 3,792,925 2/1974 Milligan et al. ..... 355/300
3,893,761 7/1975 Buchan et al. ..... 355/272
3,904,406 9/1975 Takahashi ..... 96/1.4
4,144,808 3/1979 Iwasa et al. ..... 101/494
4,341,455 7/1982 Fedder ..... 355/274

FOREIGN PATENT DOCUMENTS 59-31990 2/1984 Japan .

*Primary Examiner*—R. L. Moses
*Attorney, Agent, or Firm*—Willian Brinks Olds Hofer Gilson & Lione

[57] ABSTRACT

An image forming apparatus provided with a mechanism for causing an intermediate transfer member to be in contact with a photoconductor while a toner image formed on the photoconductor after development is firstly transferred onto the intermediate transfer member and otherwise keeps the transfer member away from the photoconductor.

The mechanism for causing contact or separation keeps the intermediate transfer member away from a cleaner by its function of contacting the intermediate transfer member with the photoconductor, and keeps the intermediate transfer member in contact with the cleaner by its function of keeping the intermediate transfer member away from the photoconductor.

12 Claims, 7 Drawing Sheets

IMAGE FORMING METHOD AND APPARATUS HAVING INTERMEDIATE TRANSFER MEMBER WHICH IS MOVABLE TOWARD AND AWAY FROM A PHOTOCONDUCTOR

BACKGROUND OF THE INVENTION

1. Technical Field of the Invention

The present invention relates to an image forming apparatus such as copying machines and laser beam printers, and more particularly to an image forming apparatus which is arranged to firstly transfer an image form a photoconductor onto an intermediate transfer member and secondly further transfer the image onto a transfer material.

2. Brief Description of Related Art

U.S. Pat. No. 3,904,406 discloses an apparatus which is designed to print a multicolored image on a flexible material such as cloth by applying an electrophotography. The apparatus is arranged to successively form each colored image on a photoconductor and to firstly transfer the image onto an intermediate transfer member one after another each time the image is formed, and thereafter, a multicolored image formed on the intermediate transfer member is secondly pressed to be transferred onto a flexible material under electrostatic pressure.

However, in an image forming apparatus, a photoconductor and an intermediate transfer member are always pressed in contact with each other, and therefore, it is required to drive both of them even if only one of them is required to be driven since it results in scratching the one which is not driven. Besides, it is inevitable to have physical damage when both of them are driven since they are always in contact with each other. Further, there has been a problem of causing electrical fatigue as the result of repetition of frictional charge and exfoliating discharge which repeatedly occur when the surface of both members contact each other at their contacting portions and are separated after passing through the contacting portions.

SUMMARY OF THE INVENTION

The main object of the present invention is to provide an image forming apparatus capable of suppressing the damage and electrical fatigue of a photoconductor and an intermediate transfer member by making the intermediate transfer member contact the photoconductor only for a required period of time.

Another object of the present invention is to provide an image forming apparatus capable of functioning with a simple structure to make an intermediate transfer member contact and separate from a photoconductor properly without any problem.

A further object of the present invention is to provide an image forming apparatus capable of correlatively driving an intermediate transfer member to contact and separate from a photoconductor properly and a cleaning blade to contact and separate from the intermediate transfer member properly by one driving means so that a multiplex first transfer is carried out advantageously.

The other objects and features of the present invention will become more apparent from the following description taken in conjunction with the accompanying drawings.

BRIEF DESCRIPTION OF THE DRAWINGS

It is to be noted that like parts are shown by corresponding reference characters throughout the several embodiments and repeated descriptions.

DESCRIPTION OF THE PREFERRED EMBODIMENTS

Some of the embodiments of the present invention will now be described below with reference to the accompanying drawings. FIGS. 1 through 6 illustrate a first embodiment of the present invention which is applied to a color copying machine.

Figure 1:
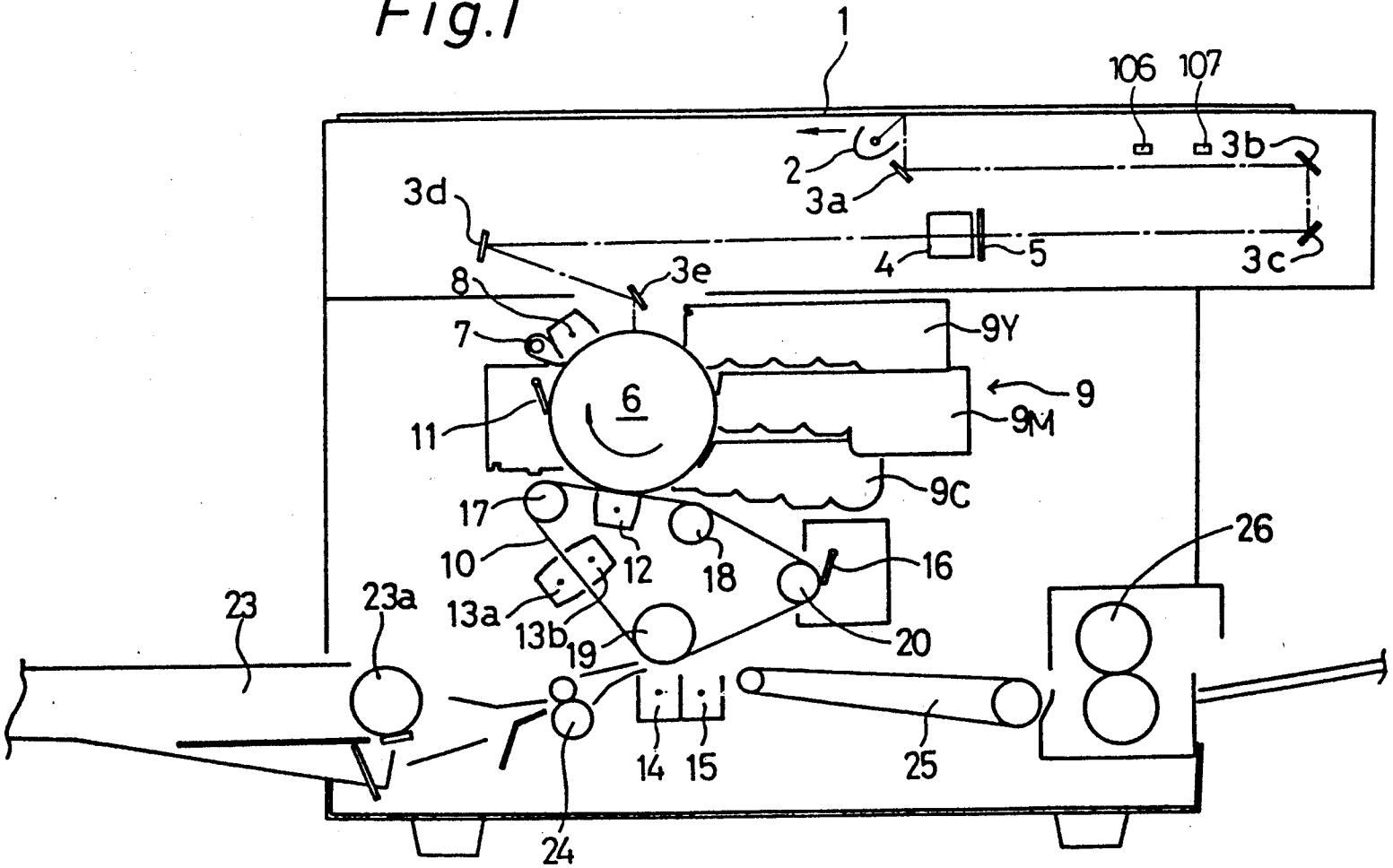
FIG. 1 is a diagrammatic view of the whole structure of a copying machine showing a first embodiment of the present invention as applied to a color copying machine.

In FIG. 1, the numeral 1 designates an original glass table on which an original is placed and under the original galss table 1, there are disposed an optical system comprising an exposure lamp 2, a first through a fifth mirrors 3*a*–3*e*, a lens 4 and a color decomposition filter unit 5.

The exposure lamp 2 and the first mirror 3*a* are moved with a velocity of v/n (n is a copying magnification) in the direction of the arrow and scans an original on the original glass table 1. At this time, the reflected light from each portion of the original is successively exposed through a slit onto a photoconductive drum 6 provided under the fifth mirror 3*e* through the first-third mirrors 3*a*–3*c*, the color decomposition filter unit 5, the lens 4 and the fourth and fifth mirrors 3*d*,3*e*. The second and third mirrors 3*b*,3*c* are moved with a velocity of v/2n in the same direction as that of the first mirror 3*a* to prevent the change of light path length which tends to occur by the scanning movement of the first mirror 3*a*.

Figure 2:
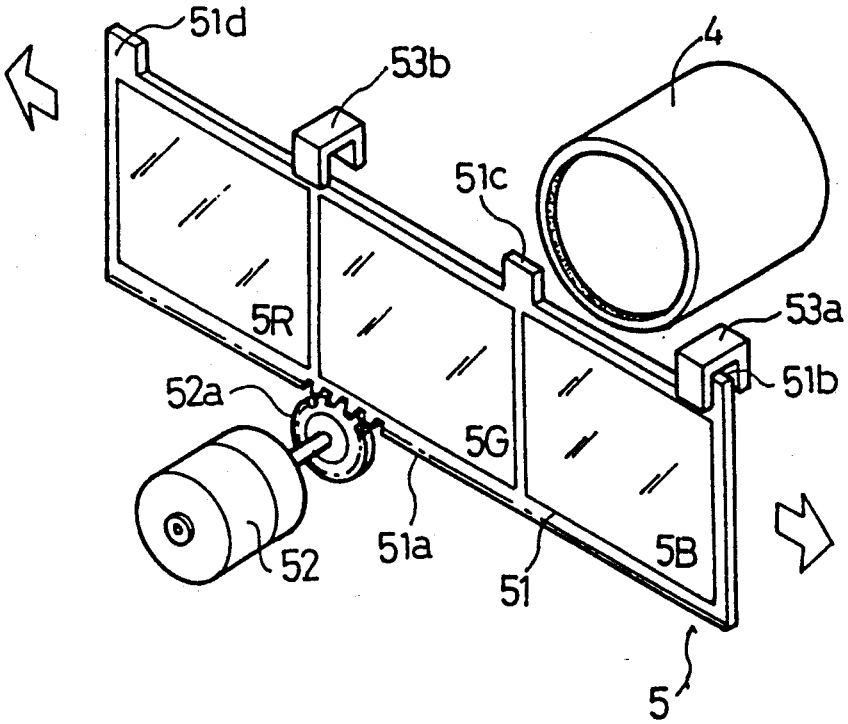
FIG. 2 is a perspective view of a filter which is provided for a copying machine.

The color decomposition filter unit 5 is provided, as shown in FIG. 2, with a blue filter plate 5B, a green filter plate 5G and a red filter plate 5R supported in parallel by a frame 51. A rack 51*a* is formed on the frame 51, and a pinion 52*a* which is directly connected to a drive motor 52 is engaged with the rack. On the frame 51, there are also provided projections 51*b*, 51*c* and 51*d* for position detection, and according to the result of detection made with position sensors 53*a* and 53*b* mounted on the fixed positions of the projections 51*b*–51*d*, it is judged which filter plate is on the exposure light path. Accordingly, one of the filter plates 5B, 5G or 5R can selectively be positioned on the exposure light path by moving the frame 51 with the drive motor 52 based on the judgement.

Around the photoconductive drum 6, an eraser lamp 7, a charger 8, a developing section 9, an intermediate transfer belt 10 and a drum cleaner 11 are sequentially disposed in the direction of rotation of the photoconductive drum 6. Accordingly, after residual charge on the photoconductive drum 6 is erased by the eraser lamp 7, the surface of the photoconductive drum is uniformly charged by the charger 8 to be ready for the above-mentioned exposure. The exposure is made under the state of color decomposition by the selected filter plates 5B, 5G or 5R.

Figure 3:
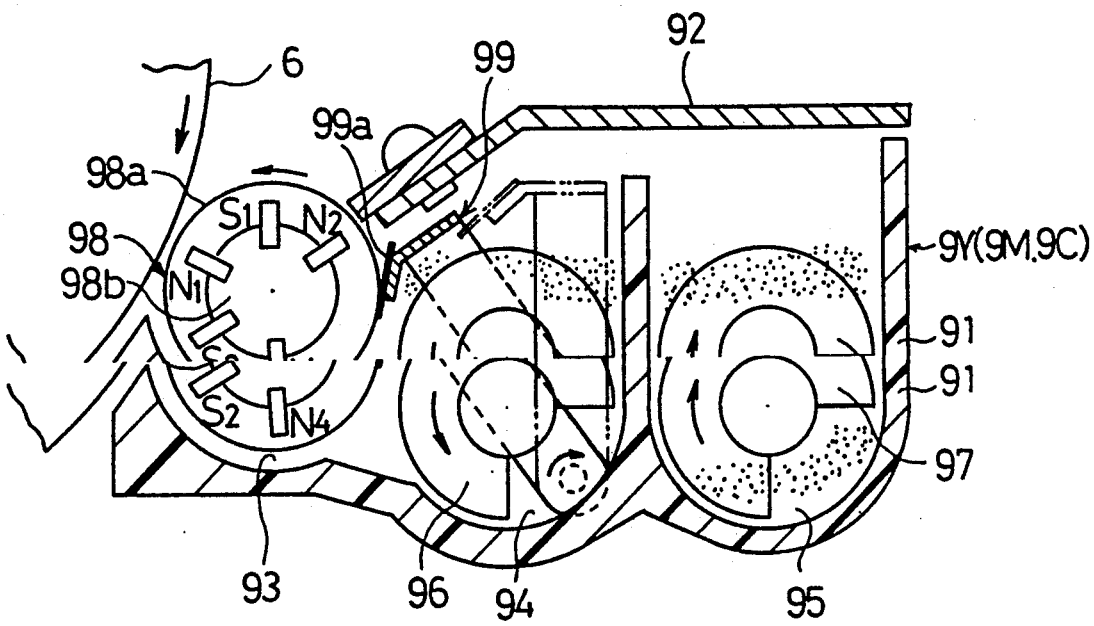
FIG. 3 is a cross-sectional view of a developing unit provided for a copying machine.

The developing section 9 is provided with a yellow developing unit 9Y including yellow toner, a magenta developing unit 9M including magenta toner and a cyan developing unit 9C including cyan toner which are disposed for selective use for developing with colored toner corresponding to an electrostatic latent image formed on the photoconductive drum 6 by an exposure under each state of color decomposition. Each one of the developing units 9Y, 9M and 9C are accommodated in a developer tank formed by a casing 91 and a cover 92 as illustrated in FIG. 3, in which a developing roller 93 and developer transport paths 94,95 are sequentially formed from the side of the photoconductive drum 6. The transport paths 94 and 95 are divided by a partition, however, they are connected each other at their end portions and developer is circulatively transported while being stirred with screws 96,97. A two-component developer including a magnetic carrier and a colored toner is used, and toner is frictionally charged while being stirred in the circulative transport. The charging polarity is, for instance, a positive polarity contrary to that of the photoconductive drum 6.

The screw 96 in the transport path 94 supplies the developer being circulatively transported in the transport path 94 to a developing roller 98 accommodated in the developing roller accommodating section 93. The developing roller 98 comprises a developing sleeve 98*a* which is rotatively driven and a magnetic roller 98*b* fixedly disposed therein. The developing sleeve 98*a* absorbs and holds the developer supplied thereto and transports it to the photoconductive drum 6 for development.

The developer used for development is again transported into the developer tank with, rotation of the developing sleeve 98*a*, and when it reaches the portion where no magnetic pole of the magnetic roller 98*b* is located, it is returned into the developer being transported in the transport path 94 by the function of the repulsive magnetic field of two magnetic poles $N_2$ and $N_4$.

A developer scraping shutter 99 is provided in the developer tank, and by positioning a shutter blade 99*a* at the position to contact the circumferential surface of the developing sleeve 98*a* as shown by a solid line in FIG. 3, the supply of developer from the screw 96 to the developing sleeve 98*a* is obstructed. The developer adsorbed on the circumferential surface of the developing sleeve 98*a* and returned to the developer tank is scraped up. Accordingly, the developer is not supplied to the photoconductive drum 6 leaving the developing unit in an unused state.

When the shutter blade 99*a* is moved backward from the position of developing sleeve 98*a* as shown by phantom line in FIG. 3, the obstruction of supplying developer to the developing sleeve 98*a* is released and the developing unit is put under an in-use state since the scraping up of developer from the developing sleeve 98*a* is released. By preparing any one of the developing units 9Y, 9M or 9C to be ready for use, it can selectively be operated.

The intermediate transfer belt 10 is made of a flexible dielectric material having characteristics of environmental resistance and dimensional stability, for instance, an endless belt made of a material such as polyamide film in the thickness 50–10 μm. Around the circumference of the intermediate belt 10, there are disposed a first transfer charger 12 for transferring an image from the photoconductive drum 6 onto the intermediate transfer belt 10, second transfer pretreatment chargers 13*a*,13*b*, a second transfer charger 14 for transferring an image from the intermediate transfer belt 10 to a transfer material, an eraser charger 15 and a belt cleaner 16.

Figure 4:
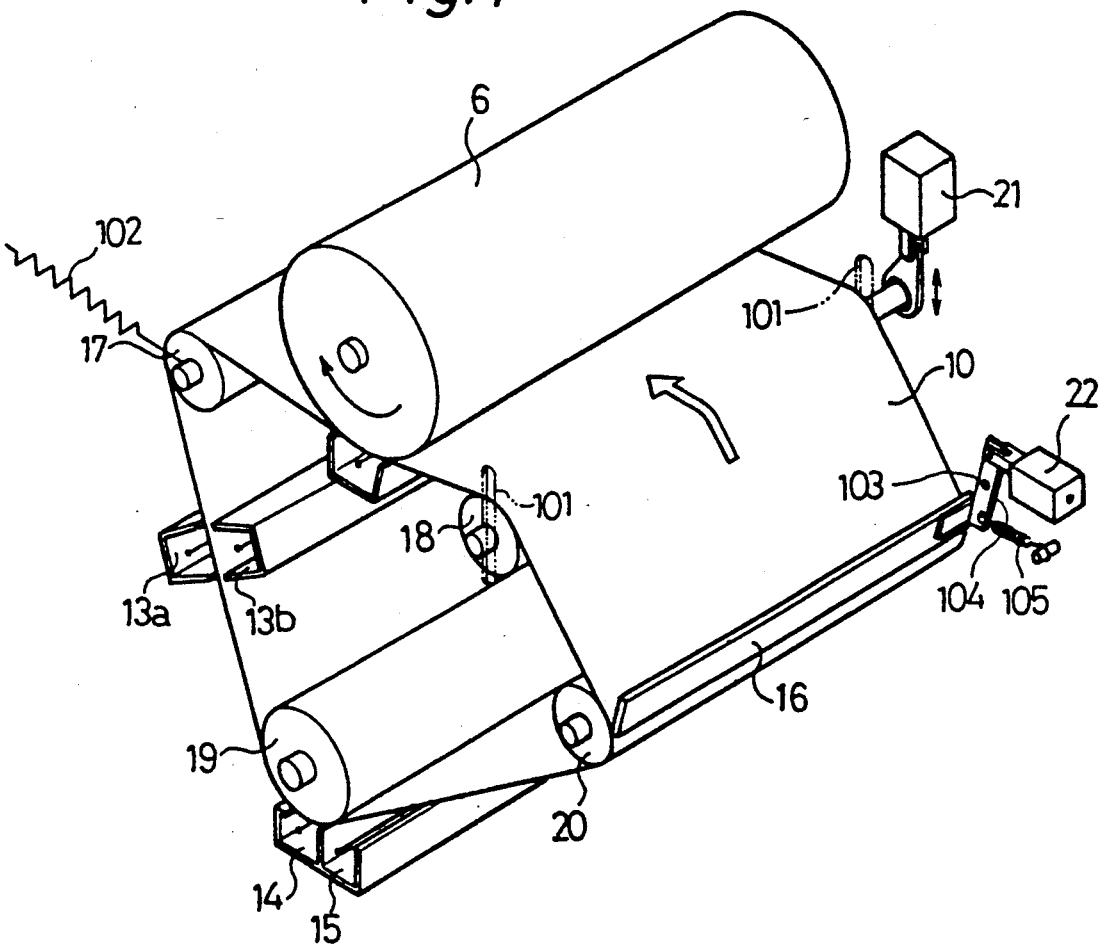
FIG. 4 is a perspective view illustrating a state how a photoconductive drum and an intermediate transfer belt for a copying machine are set.
Figure 5:
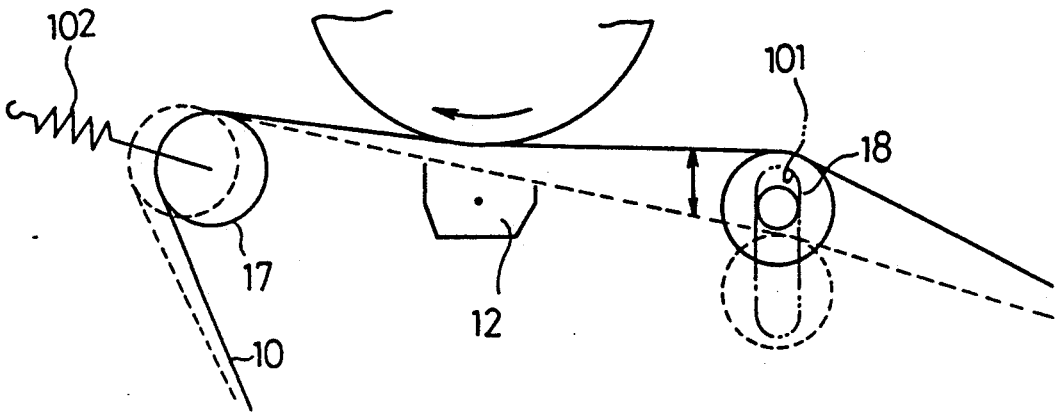
FIG. 5 is a side view showing a state how an intermediate transfer belt gets in contact with and separates from a photoconductor.

The intermediate transfer belt 10 is stretched by four straight rollers, i.e., pressure rollers 17,18 on both sides of the first transfer charger 12, a second transfer roller 19 and a belt cleaner roller 20 as shown in FIGS. 4 and 5.

The pressure roller 18 is moved upward and downward along a guide groove 101 provided on side frames of the apparatus by turning on and off of a solenoid 21 connected to one end of the roller 18, and makes the intermediate transfer belt 10 contact or separate from the photoconductive drum 6 as illustrated in FIG. 5. Another pressure roller 17 is energized by a spring 102 and functions as a dancing roller.

The belt cleaner 16 is connected to a solenoid 22 via lever 104 pivotally supported by a shaft 103 in its center and is biased in the direction away from the intermediate transfer belt 10 by a spring 105. When the solenoid 22 is turned on, the belt cleaner 16 is pressed to contact the intermediate transfer belt 10 against the spring 105 through the lever 104. The contacting position is the portion where the intermediate transfer belt 10 is guided by the belt cleaner roller 20 so that the intermediate transfer belt 10 is firmly stretched.

The second transfer roller 19 guides the intermediate transfer belt 10 to keep a predetermined gap between the second transfer charger 14 so as to stably carry out a second transfer. A sheet transported from a paper feed cassette 23 by a paper feed roller 23*a* is transported into the second transfer section through a register roller 24.

The register roller 24 is arranged to prevent a transfer sheet being transported thereto from skewing by adjusting its leading end, and coordinates with the leading end of an image formed on the intermediate transfer belt 10 by the timing of the transfer sheet to be transported. The transfer sheet after completing the second transfer process is then transported into a fixing unit 26 by a transport belt 25. Thereafter, the fixing unit 26 sends out the transfer sheet while giving fixing process to an image on the transfer sheet.

A series of movements will now be described below. An original placed on the original glass table 1 is scanned by movement of the exposure lamp 2 and the first mirror 3*a*, and the reflected light creates an image on the photosensitive surface of the photoconductive drum 6 through the first-third mirrors 3a–3c, the color decomposition filter unit 5, the lens 4 and the fourth, fifth mirrors 3d–3e. After the charge on the photoconductive drum 6 is erased by the eraser lamp 7, the drum 6 is charged, for instance, at a certain negative potential, by the charger 8, and is rotatively exposed simultaneously with the scanning. When the photosensive surface is irradiated by the reflected light from an original, the surface potential is varied according to the intensity of light thereby forming an electrostatic latent image.

The electrostatic latent image is then developed by colored toner with one of the three developing units, i.e., the yellow developing unit 9Y, the magenta developing unit 9M or the cyan developing unit 9C provided in the developing section 9. For instance, if the blue filter plate 5B is positioned in the light path, the yellow developing unit 9Y is selected which is a complementary color of blue. At this stage, the other developing units 9M and 9C are put under non-use state wherein the developer on the developing roller 98 is scraped up with the developer scraping shutter 99 provided behind each developing roller 98 and the supply of developer to the developing roller 98 is obstructed. Then, the yellow developing unit 9Y is driven under the state where the height cutting shutter 99 is not actuated. Accordingly, the electrostatic latent image on the photoconductive drum 6 is developed by yellow toner and visualized.

The intermediate transfer belt 10 is driven simultaneously with the photoconductive drum 6 at the uniform velocity of the drum 6, and a toner image on the photoconductive drum 6 is transferred onto the intermediate transfer belt 10 by the first transfer charger 12 on which negative potential is being given. Thereafter, the photosensitive surface of the photoconductive drum 6 is cleaned by the drum cleaner 11 to finish the exposure-development-first transfer procedure.

In case of full color copying, upon finishing the first round of exposure-development-first transfer process on the yellow as above mentioned, the green filter 5G is selected by the color decomposition filter unit 5 and is positioned on the light path, and the photosensitive surface of the photoconductive drum 6 is exposed by the original reflected light passed therethrough thus forming an electrostatic latent image. This latent image is developed and visualized by magenta toner which is a complementary color of green by selective use of the magenta developing unit 9M, and the magenta toner image is transferred overlapping with the yellow toner image on the intermediate transfer belt 10.

The circumferential length of the intermediate transfer belt 10 is arranged to be longer than that of the photoconductive drum 6. Accordingly, the timing for starting a second exposure is set according to the time required after the first exposure is started, so that the leading end of the image formed on the intermediate transfer belt 10 by the first round of procedure, i.e., exposure-development-first transfer, coordinates with the leading end of the image which is to be formed on the intermediate transfer belt 10 by the second round of procedure, i.e., exposure-development-first transfer. The detection for exposure start is made by a position sensor 106 disposed at an exposure starting position of the exposure lamp 2 and the first mirror 3a as shown in FIG. 1 which detects the exposure lamp 2 and the first mirror 3a.

The numeral 107 designates a position sensor for detecting a home position of the exposure lamp 2 and the first mirror 3a. Reed switches may adequately be utilized for the sensors 106 and 107.

Upon finishing the second round of procedure, i.e., exposure-development-first transfer, the red filter 5R is selected for the third round of procedure by the color decomposition filter unit 5 and is positioned on the light path, and the photosensitive surface of the photoconductive drum 6 is exposed by the original reflected light thus forming an electrostatic latent image. This latent image is developed and visualized by cyan toner which is a complementary color of red by selective use of the cyan developing unit 9C, and the cyan toner image is transferred overlapping with the yellow and magenta toner images on the intermediate transfer belt 10 thus forming full color toner image by yellow, magenta and cyan.

When the first transfer process is being made, the belt cleaner 16 of the intermediate transfer belt 10 is put away from the belt 10 by turning off the solenoid 22.

At the stage when the first transfer procedure is finished, the solenoid 21 is turned off and the intermediate transfer belt 10 is put away from the photoconductive drum 6 by moving the pressure roller 18. The intermediate transfer belt 10 is driven under such state. The intermediate transfer belt 10 is pressed to contact the photoconductive drum 6 only when the first transfer procedure is made and the belt 10 is put away from the drum 6. Accordingly, the photoconductive drum 6 is stopped when the first transfer is finished. The damage and electrical fatigue which tends to occur from repeated frictional charge and exfoliating discharge can be avoided since the photoconductive drum 6 and the intermediate transfer belt 10 are separated.

Then, the full color toner image on the intermediate transfer belt 10 is precharged by the second transfer pretreatment chargers 13a,13b. In other words, the same degree of positive potential as that of the toner image is given to the pretreatment charger 13a on the surface of the intermediate transfer belt 10, and to the pretreatment charger 13b on the reverse side of the belt 10, negative potential is given thereby strengthening the charge on the toner image prior to the second transfer. Thereafter, the toner image moves to the location where the second transfer charger 14 is positioned.

The position of the leading end of the image on the intermediate transfer belt 10 can be obtained by counting the time taken for the third round of procedure, i.e., exposure-development-first transfer, from the time the exposure is started. A transfer sheet should, therefore, be sent out from the paper feed cassette 24 a little earlier than the time the leading edge meet the leading end of the image on the intermediate transfer belt and stop the sheet temporarily at the position of the register roller 24. Thereafter, the transfer sheet is sent out to the transfer section by driving the register roller 24 with the timing the leading end of both the transfer sheet and the image on the intermediate transfer belt meet each other.

In the transfer section, a full color toner image on which positive potential is given on the intermediate transfer belt 10 is electrostatically adsorbed by the second transfer charger 14 on which negative potential is given, and thereafter, the image is transferred onto the transfer sheet. The transfer sheet on which the toner image is transferred is erased with the eraser charger 15 by giving AC potential thereon and is then separated from the intermediate transfer belt 10. The transfer sheet after being separated from the belt 10 is adsorbed and transported by a transfer sheet transport belt 25 to a heated fixing unit 26 and thereafter discharged after the fixing process.

Figure 6:
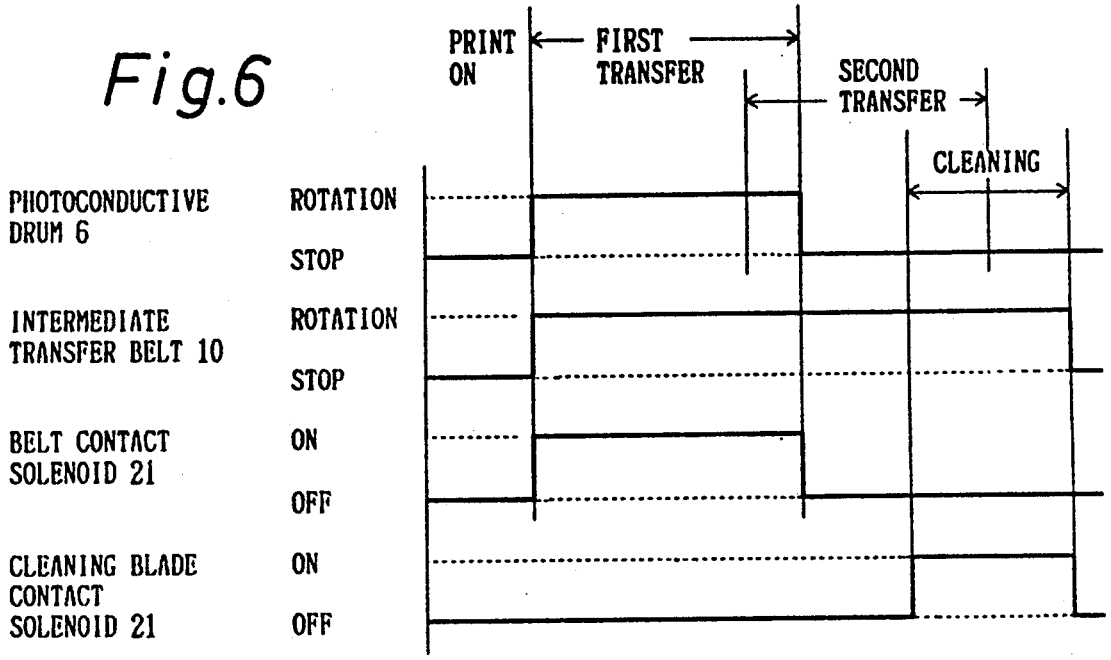
FIG. 6 is a time chart of the main actions of a copying machine.

The intermediate transfer belt 10 that finished a second transfer process is cleaned with the belt cleaner 16 by turning on the solenoid 22 to be ready for next procedure. The state of the photoconductive drum 6, the intermediate transfer belt 10 and the solenoids 21,22 in the course of the above-mentioned procedure is illustrated in FIG. 6.

By strengthening the charging state on a toner image with pretreatment chargers 13*a* and 13*b* prior to a second transfer process, even if the electric charge of the toner image transferred in a first and second cycle of the first transfer process is reduced at the time of a second and third cycle of the first transfer process and even in the portion where electric charge is easily decreased after the second cycle of the first transfer process, sufficient electric charge is maintained by a second charging and the toner image is transferred stably and efficiently just like the case where the toner image formed in a first cycle of the first transfer process on which no toner image was formed at the second and third cycles of the first transfer process.

In the above description, a case is described wherein the photoconductive drum 6, the first transfer charger 12, the reverse side pretreatment charger 13*b* and the second transfer charger 14 are negatively charged while toner and the surface pretreatment charger 13*a* are positively charged. However, the manner of charging may be reversely applied.

In the above example, a full color toner image is formed on the intermediate transfer belt 10 upon making three cycles of the first transfer process and then transfer the image onto a transfer sheet, however, a mode may be provided for forming unicolor images to transfer the image. In this case, a pretreatment charger may be arranged to be actuated or not to be actuated.

Further, the intermediate transfer belt 10 is exemplified as an intermediate transfer member in the above embodiment, however, an intermediate transfer drum may be utilized. The intermediate transfer member may be positioned in contact with or separate from a photoconductive drum 6 by moving the whole intermediate transfer member in the transverse direction or other proper direction. In this case, it is advantageous to use a drum as an intermediate transfer member.

Figure 7:
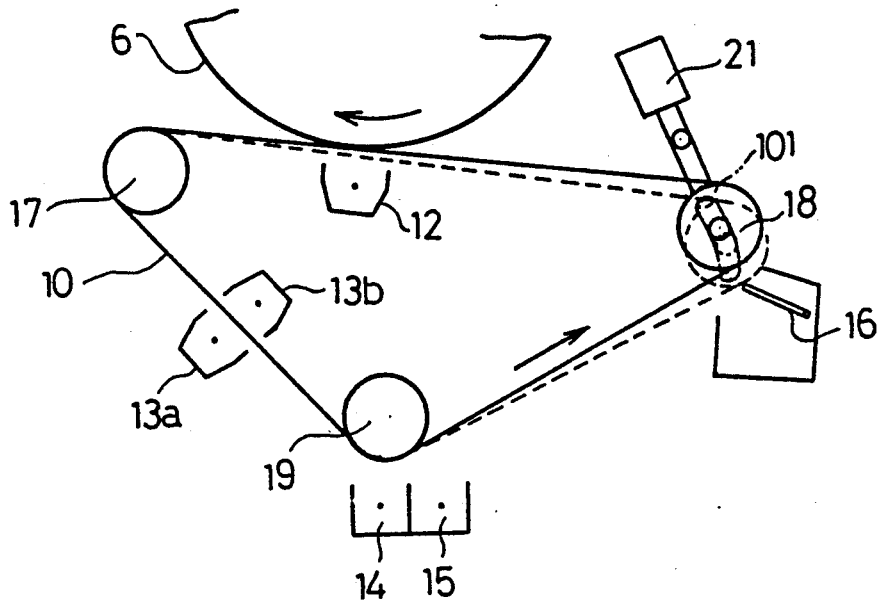
FIG. 7 is a side view of an intermediate belt and its surroundings showing a second embodiment of the present invention.

FIG. 7 shows a second embodiment of the present invention. In this embodiment, an intermediate transfer belt 10 is stretched by only three rollers, i.e., pressure rollers 17,18 and a second transfer roller 19. The pressure roller 18 is moved upward and downward by a solenoid 21 and places the intermediate transfer belt in contact with or away from a photoconductive drum 6. Guide grooves 101 which guide the upward and downward movement of the pressure roller 18 are formed on the frames in a curved shape to provide an elliptical orbit for the pressure roller 18 to move therein by keeping the intermediate transfer belt 10 in tensional state. Accordingly, it is not necessary for the pressure roller 17 to be provided with the function of a dancing roller as in the first embodiment. The pressure roller 18 makes the intermediate transfer belt 10 contact a belt cleaner 16 when the belt 10 is positioned away from the photoconductive drum 6. Accordingly, the pressure roller 18 is made to move only upward and downward by the solenoid 21, and the relative movement of the photoconductive drum 6 and the intermediate transfer belt 10 and the relative movement of the intermediate transfer belt 10 and the belt cleaner 16 are carried out correlatively.

Figure 8:
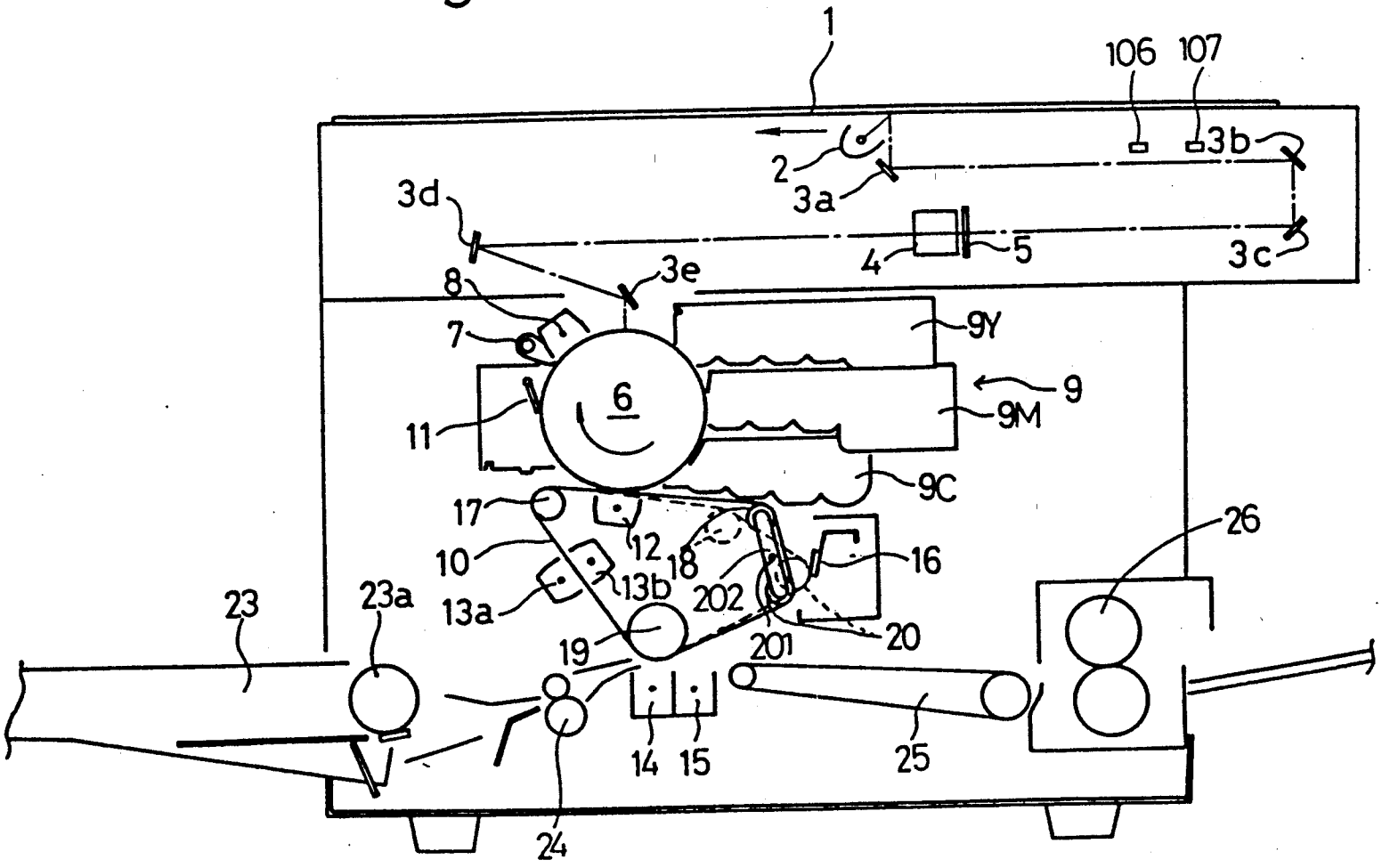
FIG. 8 is a diagrammatic view of the whole structure of a copying machine showing a third embodiment of the present invention.
Figure 9:
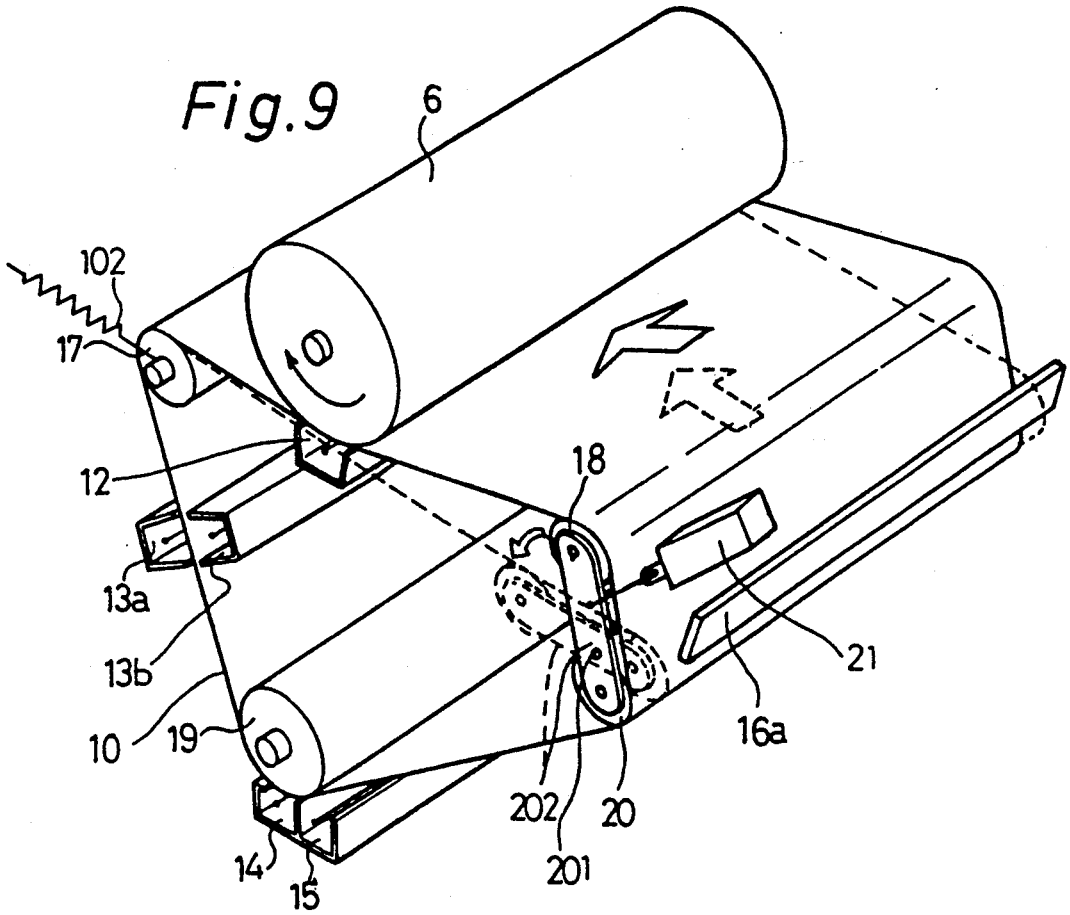
FIG 9 is a perspective view showing a state how a photoconductive drum and an intermediate transfer belt for the copying machine of FIG. 8 are set.
Figure 10:
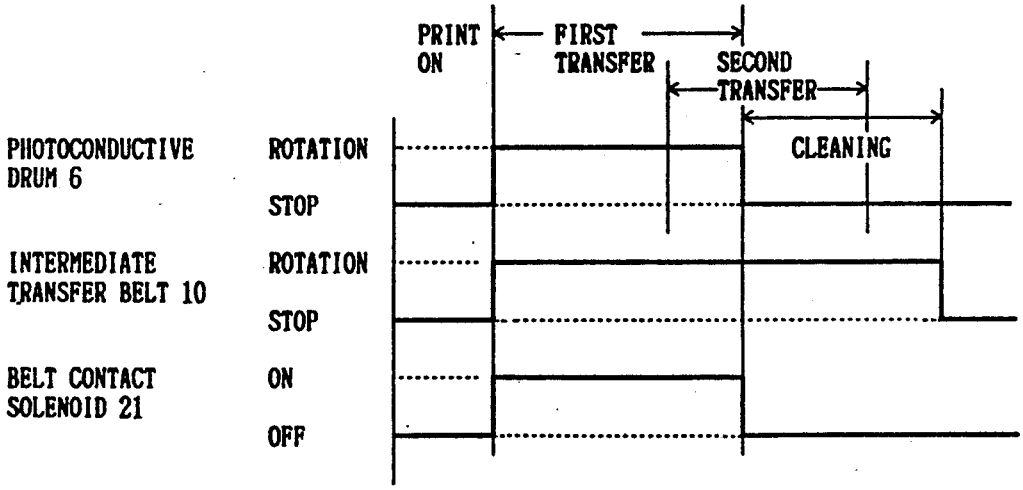
FIG. 10 is a time chart of the main actions of the copying machine of FIG. 8.

FIGS. 8 through 10 illustrate a third embodiment of the present invention. In this embodiment, as shown in FIGS. 8 and 9, an intermediate transfer belt 10 is stretched by four straight rollers, i.e., pressure rollers 17,18, a second transfer roller 19 and a belt cleaner roller 20 as in the first embodiment with the exceptions of the following. That is, the pressure roller 18 and the belt cleaner roller 20 are attached to the both ends of a rocking lever 202 rockingly supported by a pivot shaft 201 in its central portion. By rocking the rocking lever 202 with a solenoid 21 directly connected thereto, the intermediate transfer belt 10 is pressed to contact a photoconductive drum 6 by the pressure rollers 17,18. At the same time, the position of the intermediate transfer belt 10 can be changed between the first position where the belt cleaner roller 20 is kept away from the belt cleaner 16 and the second position where the intermediate transfer belt 10 is kept away from the photoconductive drum 6 by the movement of the pressure roller 18, and the intermediate transfer belt 10 is pressed to contact the belt cleaner 16 by the belt cleaner roller 20. Accordingly, the proper contact and separation between the photoconductive drum 6 and the intermediate transfer belt 10 and between the intermediate transfer belt 10 and the belt cleaner 16 are also correlatively carried out by one driving means in this embodiment. The pressure roller 17 is arranged to function with a spring 102 as a dancing roller in this case. The state of main actions are illustrated in FIG. 10.

Figure 11:
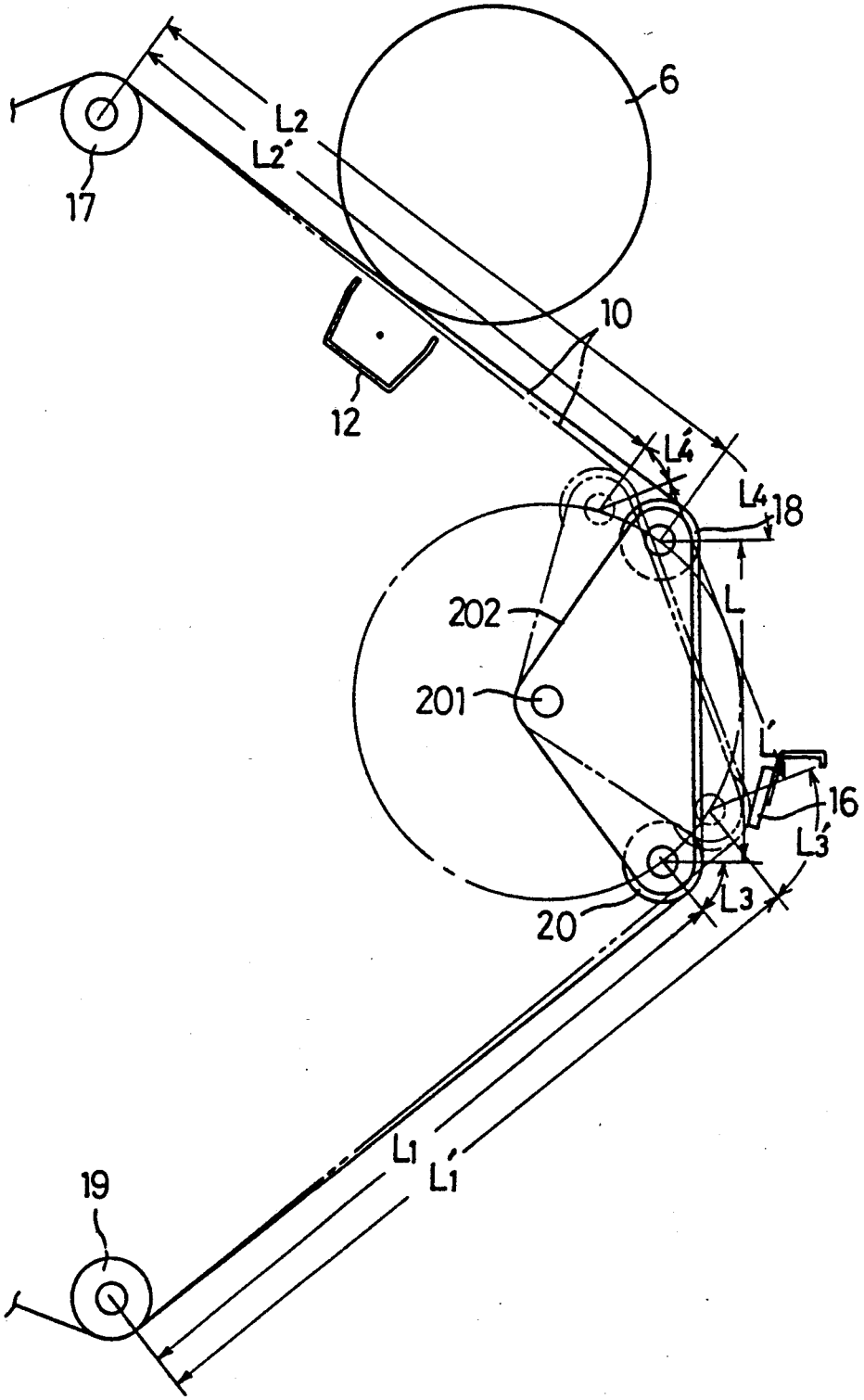
FIG. 11 is a side view illustrating a structure how an intermediate belt is set at the portions of a photoconductive drum and at a belt cleaner in a fourth embodiment of the present invention.

A fourth embodiment of the present invention illustrated in FIG. 11 shows the condition experimentally obtained by way of a diagram under which the length of an intermediate transfer belt 10 is kept unchanged when the pressure roller 18 and the belt cleaner roller 20 in the third embodiment are moved by a lever 202 and the intermediate transfer belt 10 is kept properly in contact with or separate from the belt cleaner 16.

As shown in the figure, a shaft 201 of a lever 202 is positioned to form an isosceles triangle between a pressure roller 17 and a second transfer roller 19, and on the other hand, a pressure roller 18 and a cleaner pressure roller 20 forms a reverse isosceles triangle with the shaft 201 as the apex.

In the state where both rollers 18,20 are positioned as shown by a solid line, an intermediate transfer belt 10 is pressed in contact with a photoconductive drum 6 while being kept away from a belt cleaner 16, and in the state where both rollers 18,20 are positioned as shown by a phantom line, an intermediate transfer belt 10 is kept away from the photoconductive drum 6 while being in contact with the belt cleaner. The length of the intermediate transfer belt 10 between a second transfer roller 19 and the belt cleaner roller 20 is expressed as, $L_1+\alpha=L_1'$, against which the relation between a presser roller 17 and the pressure roller 18 is expressed as, $L_2+\alpha=L_2'$.

The contacting circumferential length of the intermediate transfer belt 10 with the pressure roller 17 and with the second transfer roller 19 is the same, and the contacting circumferential length of the intermediate transfer belt 10 with the cleaner pressure roller 20 is expressed as, $L_3+\beta=L_3'$, against which the contacting circumferential length of the intermediate transfer belt 10 with the pressure roller 18 is expressed as, $L_4-\beta=L_4'$. The length of the intermediate transfer belt 10 between the roller 18 and 20 is kept unchanged as L=L. As it is apparent from the above, the length of the intermediate transfer belt 10 is kept unchanged under the states illustrated by a solid line and a phantom line, and it is also the same under the state when the rollers 18 and 20 are being moved. Accordingly, a roller to function as a dancing roller is not necessarily required.

When an intermediate transfer member is made to contact or separate from a photoconductor and a cleaner by correlative movement, it will advantageously be arranged to move the whole intermediate transfer member as a drum.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a photoconductor;

a forming means for forming an electrostatic latent image on the photoconductor;

a developing means for developing by toner said electrostatic latent image formed on the photoconductor to visualize the image;

an intermediate transfer member for firstly receiving the visualized image from the photoconductor and for secondly transferring the image onto a transfer material;

a cleaner for removing toner remaining on the intermediate transfer member after the second transfer process; and a means for correlatively causing the intermediate transfer member to contact with or separate from the photoconductor and from the cleaner.

2. An image forming apparatus as defined in claim 1 wherein said means for causing contact or separation includes a means for movably supporting said intermediate transfer member between a first position where the intermediate transfer member contacts with the photoconductor and separates from the cleaner and a second position where the intermediate transfer member separates from the photoconductor and contacts with the cleaner.

3. An image forming apparatus as defined in claim 2 wherein the intermediate transfer member is a belt and the means for causing contact or separation causes the intermediate belt to be in contact with or separate from the photoconductor by moving one or a plurality of roller members which support or guide the intermediate transfer belt.

4. An image forming apparatus as defined in claim 3 wherein the means for causing contact or separation moves the roller members in a manner to keep an orbit not to affect the length of the intermediate transfer belt.

5. An image forming apparatus as defined in claim 4 wherein the means for causing contact or separation moves a plurality of roller members correlatively by one driving means.

6. An image forming apparatus, comprising:

a photoconductor;

a forming means for forming an electrostatic latent image on the photoconductor;

a developing means for developing by toner said electrostatic latent image formed on the photoconductor to visualize the image;

an intermediate transfer member for firstly receiving the visualized image from the photoconductor and for secondly transferring the image onto a transfer material;

a cleaner for removing toner remaining on the intermediate transfer member after the second transfer process; and a means for shifting the intermediate transfer member between a first state in which the intermediate transfer member contacts the photoconductor and separates from the cleaner and a second state in which the intermediate transfer member contacts the cleaner and separates from the photoconductor.

7. An image forming apparatus, comprising:

a photoconductor;

a forming means for forming an electrostatic latent image on the photoconductor, a developing means for developing by toner said electrostatic latent image formed on the photoconductor to visualize the image;

an intermediate transfer belt for receiving the visualized image from the photoconductor and for transferring the image onto a transfer material, said intermediate transfer belt being supported by a plurality of rollers;

a cleaner for removing toner remaining on the intermediate transfer belt; and a supporting means for movably supporting at least one of said rollers between a first position where the intermediate transfer belt contacts the photoconductor and separates from the cleaner and a second position where the intermediate transfer belt separates from the photoconductor and contacts the cleaner.

8. An image forming apparatus as defined in claim 7, wherein said supporting means supports one of the rollers between the first position and the second position.

9. An image forming apparatus as defined in claim 7, wherein said supporting means supports two of the rollers between the first position and the second position, said rollers being on a common frame.

10. An image forming apparatus as defined in claim 7, further comprising:

a driving means for rotating the photoconductor, and control means for stopping the rotation of the photoconductor when the supporting means is moved from the first position to the second position.

11. A recording method for forming a color image on a transfer material, said recording method comprising:

a step of charging a photoconductor;

a step of using one of a plurality of latent image forming and developing means to form a first latent image on the photoconductor and developing said first latent image with a first developing agent;

a step of transferring the developer image onto an intermediate transfer member;

a step of using a subsequent latent image forming and developing means to form a subsequent latent image on the photoconductor and developing said subsequent latent image with a subsequent developing agent;

a step of transferring the subsequent developer image onto the intermediate transfer member;

a step of repeating the previous two steps until all of said plurality of latent image forming and developing means have deposited a developing agent onto the photoconductor to form a developer image and all of said developer images have been transferred onto said intermediate transfer member;

a step of separating the intermediate transfer member from the photoconductor;

a step of transferring the developer images from the intermediate transfer member onto the transfer material; and a step of contacting a cleaner, which is normally separated from the surface of the intermediate transfer member, to the surface of the intermediate transfer member at the time when the intermediate transfer member is separated from the photoconductor.

12. A recording method as defined in claim 11 further comprising:

a step of stopping the rotation of the photoconductor after the step of separating.

* * * * *

UNITED STATES PATENT AND TRADEMARK OFFICE

CERTIFICATE OF CORRECTION

PATENT NO. : 5,196,893

DATED : March 23, 1993

INVENTOR(S) : Hideya Nishise, et al.

It is certified that error appears in the above-identified patent and that said Letters Patent is hereby corrected as shown below:

In col. 3, line 51, change "absorbs" to --adsorbs--.

In col. 4, line 18, change "50-10$\mu$m" to --50-100$\mu$m--.

In col. 8, line 60, change "$L_2 + \alpha = L_2'$" to --$L_2 - \alpha = L_2'$--

In col. 10, line 50 (Claim 10, line 4), before "control" insert --a--.

Signed and Sealed this

Twenty-eighth Day of December, 1993

Attest:

Bruce Lehman

BRUCE LEHMAN

Attesting Officer

Commissioner of Patents and Trademarks